US011801411B2

(12) United States Patent
Holovko

(10) Patent No.: US 11,801,411 B2
(45) Date of Patent: Oct. 31, 2023

(54) TRAINING DEVICE

(71) Applicant: Oleksii Holovko, Luhansk (UA)

(72) Inventor: Oleksii Holovko, Luhansk (UA)

( * ) Notice: Subject to any disclaimer, the term of this patent is extended or adjusted under 35 U.S.C. 154(b) by 0 days.

(21) Appl. No.: 17/652,240

(22) Filed: Feb. 23, 2022

(65) Prior Publication Data

US 2022/0273977 A1 Sep. 1, 2022

(30) Foreign Application Priority Data

Feb. 26, 2021 (UA) ..... a 2021 00929

(51) Int. Cl.
*A63B 21/00* (2006.01)

(52) U.S. Cl.
CPC ..... *A63B 21/0004* (2013.01); *A63B 21/4043* (2015.10)

(58) Field of Classification Search
None
See application file for complete search history.

(56) References Cited

U.S. PATENT DOCUMENTS

D262,730 S * 1/1982 Lambert, Jr ..... D21/694
D262,814 S * 1/1982 Lambert, Jr ..... D21/694
D267,420 S * 12/1982 Malachowsky ..... D21/679
5,431,617 A * 7/1995 Rattray, Jr. ..... A63B 21/04 482/121
5,613,928 A * 3/1997 Laudone ..... A63B 23/03533 482/99
6,010,439 A * 1/2000 Bullard, Jr. ..... A63B 21/4029 482/106
6,663,542 B1 * 12/2003 Trabbic ..... A63B 21/0724 482/106
7,967,737 B2 * 6/2011 Watson ..... A63B 5/20 482/139
9,149,676 B2 * 10/2015 Callanan ..... A63B 21/4035
9,254,410 B1 * 2/2016 Mirza ..... A63B 23/12
11,324,992 B2 * 5/2022 Wu ..... A63B 1/00
2006/0211552 A1 * 9/2006 Williams ..... A63B 21/4017 482/93
2015/0238795 A1 8/2015 Domesick
2015/0335934 A1 11/2015 Flynn
2019/0111297 A1 4/2019 Domesick
2019/0275369 A1 9/2019 Beddoe
2020/0170874 A1 6/2020 Zargarian

FOREIGN PATENT DOCUMENTS

DE 20 2011 105 876 U1 2/2012
RU 2 259 222 C1 8/2005
TW 1739918 B 9/2021

* cited by examiner

*Primary Examiner* — Joshua Lee
(74) *Attorney, Agent, or Firm* — Saliwanchik, Lloyd & Eisenschenk

(57) ABSTRACT

The training device is made in the form of a rigid arcuate element that has a central portion and two side portions ending in free ends. The arcuate element comprises rectilinear segments connected to each other at different angles, and it contains at least four rectilinear segments on the side portions thereof.

3 Claims, 6 Drawing Sheets

TRAINING DEVICE

CROSS-REFERENCE TO RELATED APPLICATION

This application claims priority to Ukrainian Application No. a 2021 00929, filed Feb. 26, 2021, which is hereby incorporated by reference in its entirety.

The present invention relates to training devices for developing and strengthening muscles, ligaments, tendons, and joints by means of exercises for overcoming the opposing force, isometric exercises, bodyweight exercises.

A training device in the form of a convex arc that serves as a horizontal bar is known (RU 2 259 222 C1). The design of the horizontal bar in the form of a convex arc allows, when performing each exercise, to include a new group of muscles in the group of trainable muscles, moving one's hands to new places of gripping the horizontal bar, closer to its ends or farther from them. In principle, the training device in the form of a convex arc can be used separately from the horizontal bar to perform isometric and dynamic exercises.

The angle at which the palm is located when gripping the subject device is determined by the place of gripping. In the central part of the device, the angle of gripping is closer to a horizontal one, at the edges of the device it is closer to a vertical angle relative to a conditional line connecting the ends of the device. This limits the range of exercises for training muscles, ligaments, tendons, and joints at different angles.

Embodiments of the present invention provide a training device that allows one to place one's palms horizontally, vertically, and at an angle to the conditional line connecting the ends of the device, in several places across the width and height of the device and thus expand the range of exercises for training muscles, ligaments, tendons, and joints at different angles.

In embodiments in the form of a rigid arcuate element having a central portion and two side portions ending in free ends, the arcuate element comprises rectilinear segments connected to each other at different angles, the arcuate element containing at least four rectilinear segments on the side portions thereof.

Preferably, the device has rectilinear segments that are located parallel to the conditional line connecting the free ends of the device, rectilinear segments that are located perpendicular to the conditional line connecting the free ends of the device, and rectilinear segments that are located at an oblique angle to the conditional line connecting the free ends of the device.

The training device may comprise first means for suspending the device and second means for suspending the device.

The first means for suspending the device can be made in the form of two segments outwardly extending from the central portion and respectively having at their free end a hole for advancing the means for suspending.

The second means for suspending the device may be located at the free ends of the extreme segments of the device.

The second means for suspending the device can be made in the form of holes at the free ends of the extreme segments.

The second means for suspending the device can be made in the form of transverse slots at the free ends of the extreme segments.

Further, the training device according to the invention is described with reference to drawings, where:

The training device is made in the form of a rigid arcuate element consisting of rectilinear segments 1.1, 1.2 and 1.3 connected at different angles. Rectilinear segments 1.1 are located parallel to the conditional line (not shown) connecting the free ends of the device. The rectilinear segments 1.2 are located at right angles to the conditional line connecting the free ends of the device, and the rectilinear segments 1.3 are located at an oblique angle to the conditional line connecting the free ends of the device.

Figure 1:
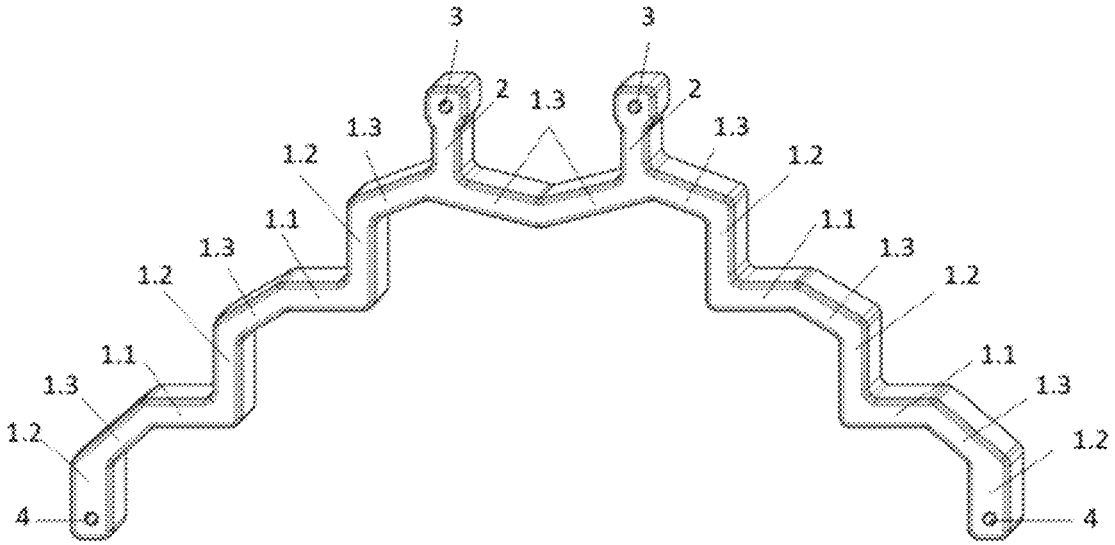
FIG. 1 shows a first embodiment of the device.

Four central rectilinear segments 1.3 form the central portion of the rigid arcuate element. Other rectilinear segments form the lateral portions of the rigid arcuate element. In the device of FIG. 1 there are seven rectilinear segments on each side portion, in the device of FIG. 2 there are five rectilinear segments on each side portion, and in the device of FIG. 8 there are eight rectilinear segments on each side portion.

The width of the device is the distance between the free ends of the device. It is determined by the range of arms of an adult or a child, depending on who the device is intended for. The height of the device is the distance from the conditional line connecting the free ends of the device to its central portion. It depends on the number of rectilinear segments and the angles of their connection on the side portions of the device.

Figure 2:
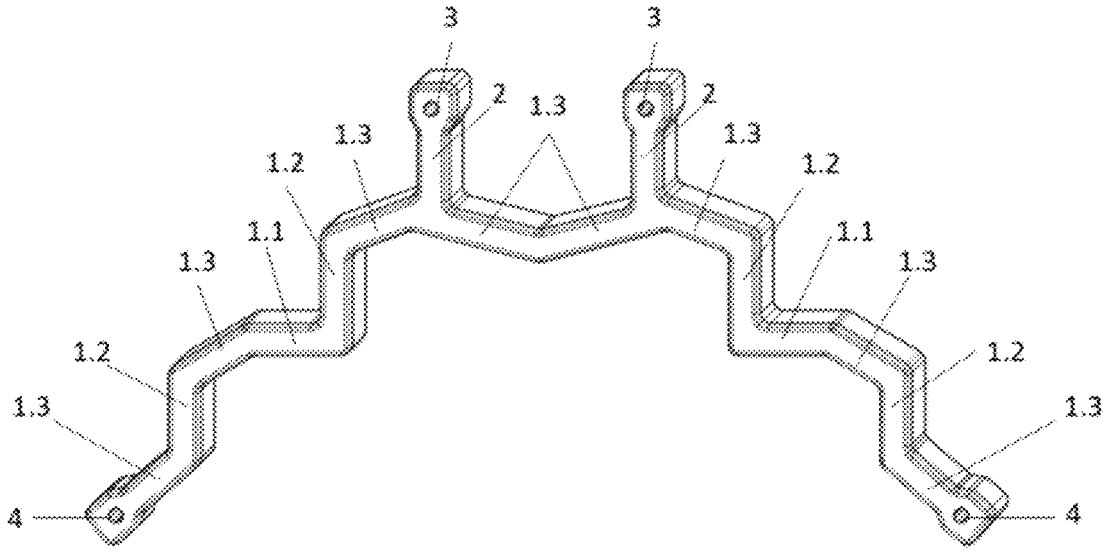
FIG. 2 shows a second embodiment of the device.

The training device comprises the first means for suspending the device and the second means for suspending the device. The first means for suspending the device are made in the form of two segments 2 outside extending from the central portion and having hole 3 for passing through the means for suspending at the free end thereof. In the area of the hole segment 2 may have an expansion (FIGS. 1, 2). The second means for suspending the device are located at the free ends of the extreme segments of the device. In one embodiment, the second means for suspending the device are made in the form of holes 4 at the free ends of the extreme segments. In another embodiment, the second means for suspending the device are made in the form of transverse slots 5 at the free ends of the extreme segments.

Figure 3:
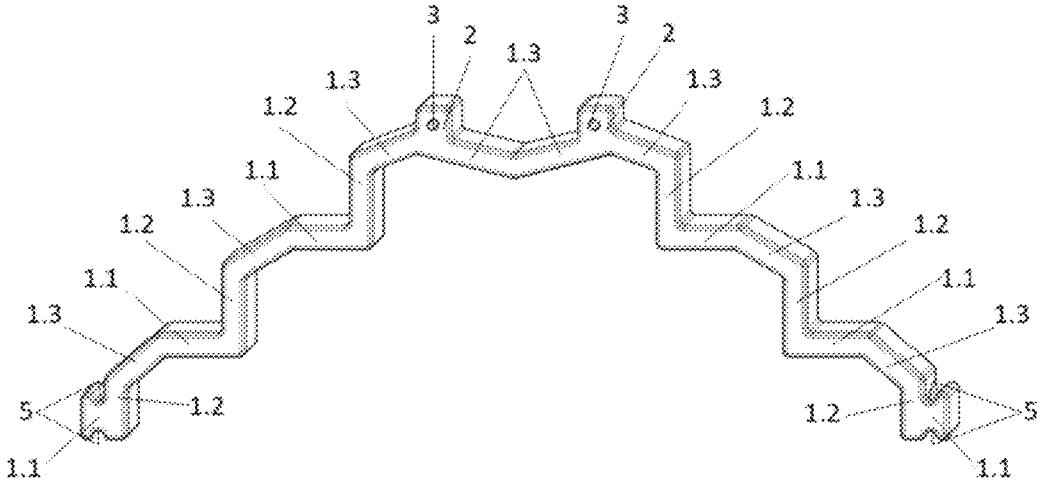
FIG. 3 shows a third embodiment of the device.

The device of FIGS. 1-3 is made of thick (40 mm) plywood. But it can be made of plastic or reinforced plastic and other materials that provide its rigidity, strength and acceptable weight. In cross-section it can be rectangular with rounded corners. The device of FIGS. 1-3 has a cross-section in the form of a square with rounded edges. There can be variants of the device with other cross-section shapes.

Figure 4:
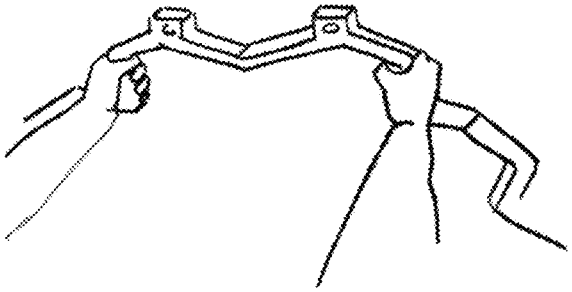
FIGS. 4, 5, 6, 7 show the types of grips of rectilinear segments of the device.
Figure 5:
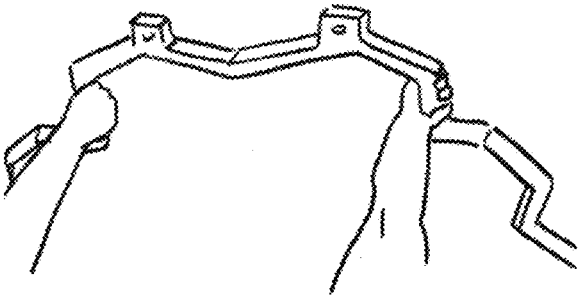
Figure 6:
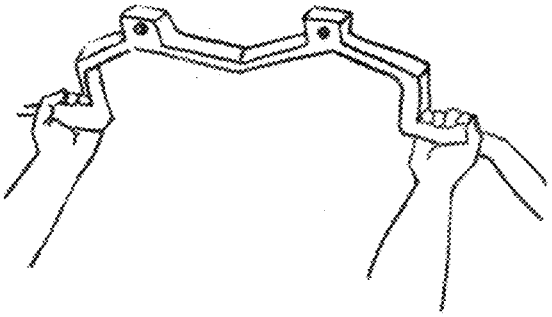

FIG. 3 shows the grip of a rectilinear segment outside the device, FIGS. 4-6 show the grip of a rectilinear segment from within. Grips are performed for different rectilinear segments of the device and, accordingly, the user's palm is located at an angle at which the rectilinear segment is located relative to the conditional line connecting the free ends of the device. Both a compressive force, and a stretching force can be applied to the device.

Further, a description of exercises follows, with references to FIGS. 7-18.

Figure 7:
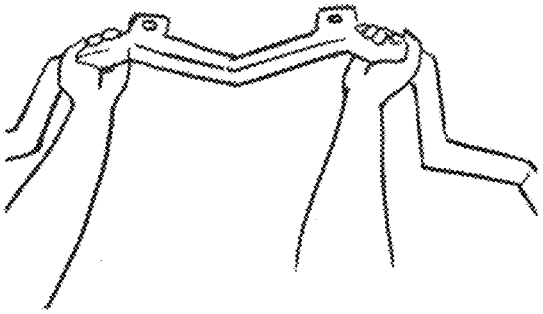
Figure 8:
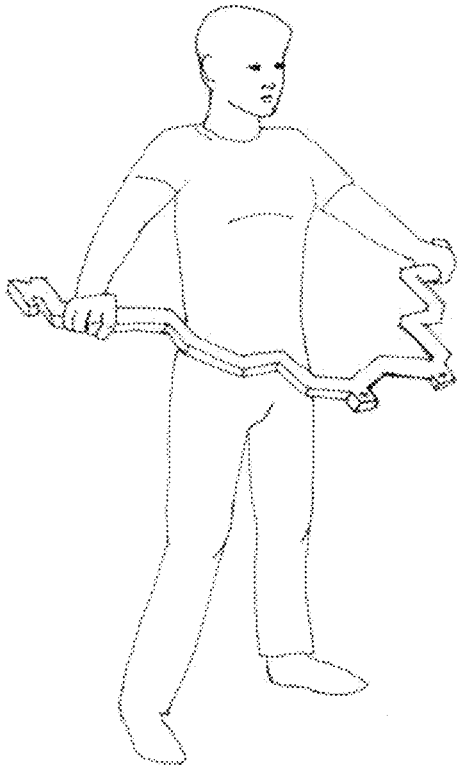
FIGS. 8, 9, 10, 11 show isostatic exercises with the device.
Figure 9:
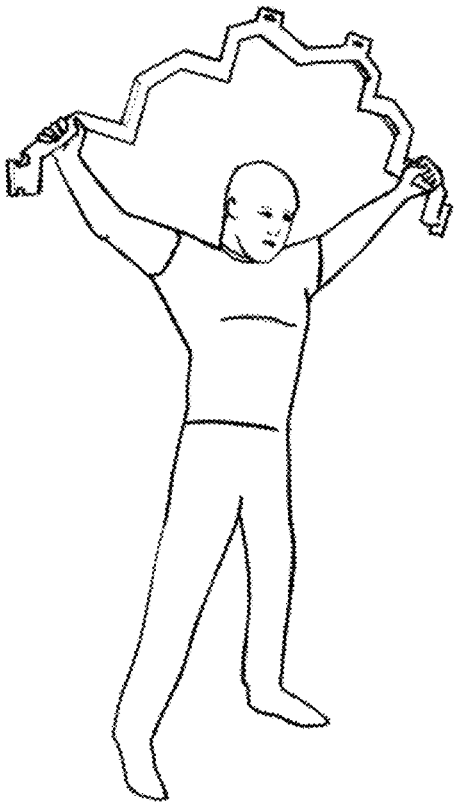

FIGS. 7 to 9 show dynamic exercises with the device; FIG. 7 shows the device in front of the trainee. FIG. 8 shows the device over the trainee, and FIG. 9 shows the device alongside of the trainee.

Figure 10:
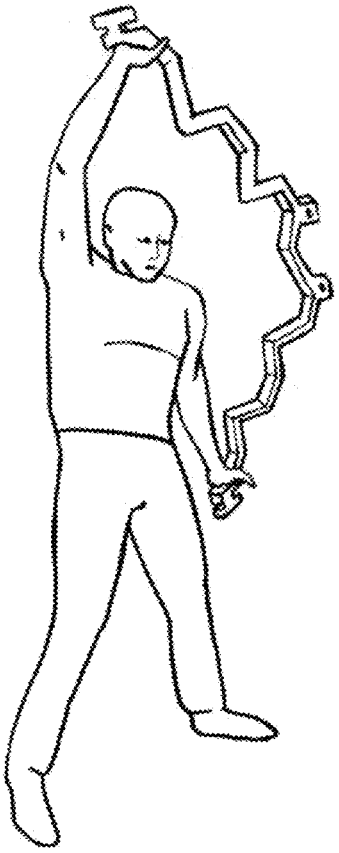
Figure 11:
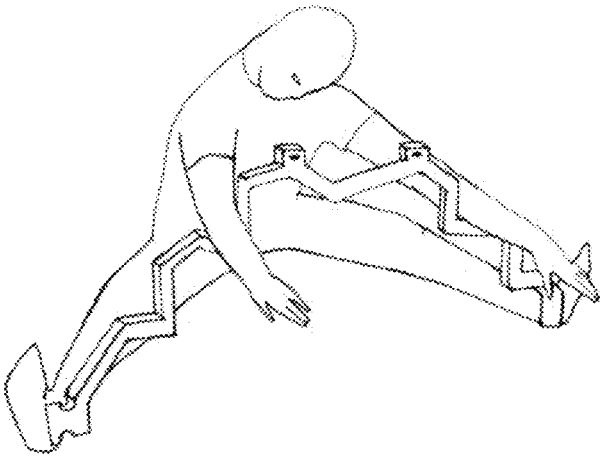
Figure 12:
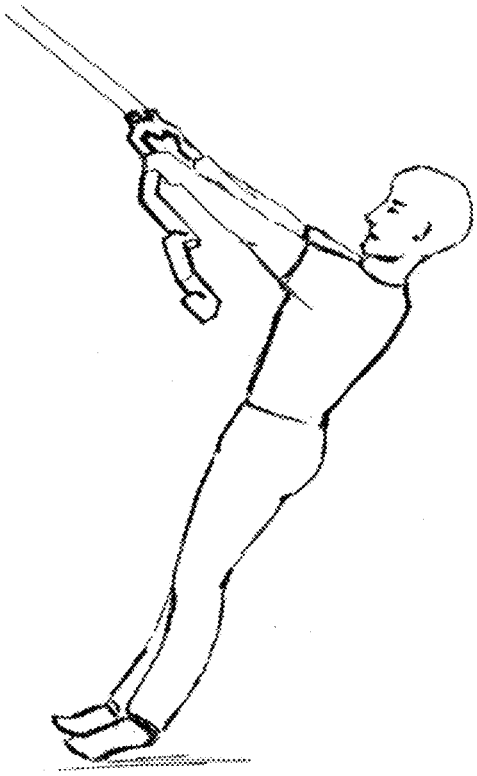
FIGS. 12, 13, 14, 15 show exercises with a suspended device.
Figure 13:
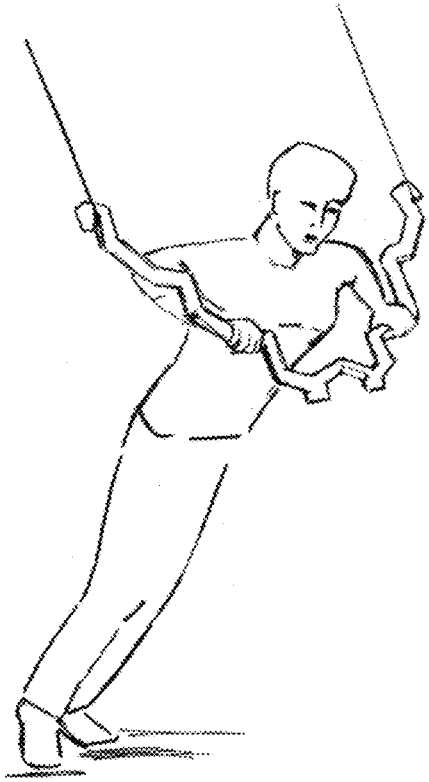
Figure 14:
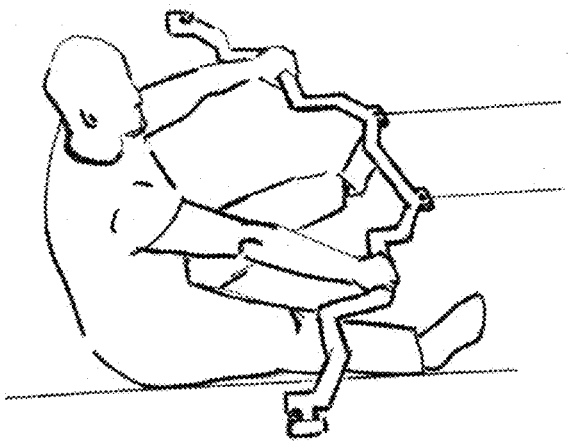

FIG. 10 shows stretching the legs across the width of the device, when the trainee is acting with shoulders on the vertical rectilinear segments.

FIGS. 11-14 show exercises with a suspended device. A cable, non-stretchable or stretchable, a belt tape, a rope, etc. can be used for suspending. One end of the cable, rope, or tape is advanced into hole 3 or 4 (FIGS. 1 and 2) and fixed, or the end of the cable, rope, or tape is located in slots 5 and fixed. The other end of the cable, rope, or tape is attached to the ceiling, wall, floor or any fixed object, such as a Swedish wall, horizontal bar, etc.

When the cable, rope, or tape is attached to the central portion of the device (FIGS. 11, 13, 14), pulling exercises can be performed. When the cable, rope, or tape is attached to the ends of the device (FIG. 12), push-ups can be performed.

Figure 15:
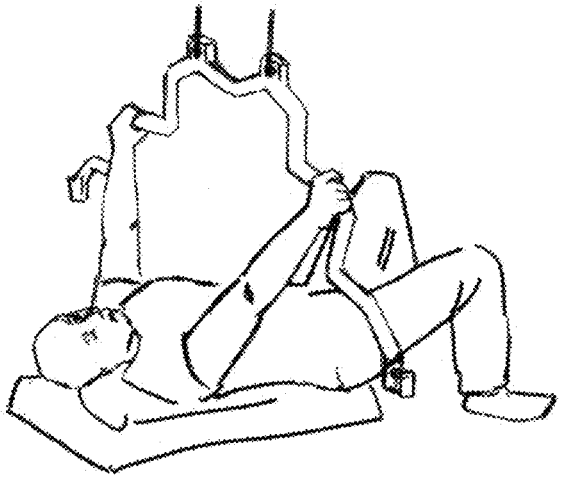
Figure 16:
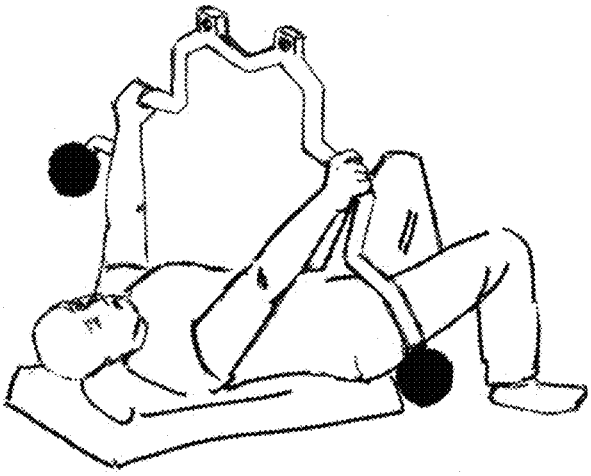
FIGS. 16, 17, 18 show exercises with the device to which weights are attached.
Figure 17:
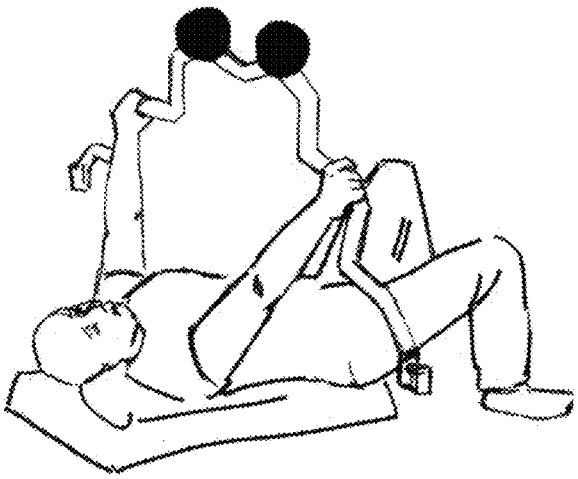
Figure 18:
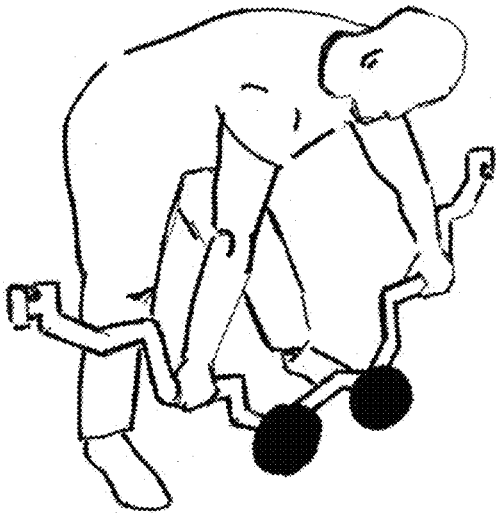

Instead of the means for suspending, in the places where they are attached (locations of holes 3, 4 and slots 5), weights can be attached to the device. In FIGS. 15-17 they are shown in the form of black balls. Means of attaching the weights are not shown, but for a person skilled in the art it is clear what types of attachments can be applied. In the device of FIG. 16, the weights are attached to the central portion of the device, in the devices of FIGS. 16 and 17, the weights are attached to the free ends of the device. FIGS. 15 and 16 show performing a press, FIG. 17 shows performing a pulling exercise.

The device is substantially designed to train the muscles, ligaments, tendons, and joints of the arms and shoulder girdle, but it is also used to train the muscles, ligaments, tendons, and joints of other parts of the body. The effectiveness of training is enhanced by the fact that the device according to the invention allows the user to implement a wide variety of grips (palm positions) and types of efforts, loads, and movements; and also allows the user to combine different types of loads and movements in one exercise. It is adapted for work with own weight (push-ups and pull-ups at various angles, including vertically), and for work with freight (various types of presses lying down and at corners, pulling exercises). It allows the user to combine isometric exercises, dynamic exercises, and breathing exercises.

What I claim is:

1. A training device in the form of a rigid arcuate element comprising:

a central portion and two side portions ending in free ends, wherein the arcuate element comprises rectilinear segments connected to each other at different angles, the arcuate element containing at least four rectilinear segments on each of the two side portions thereof; and a first means for suspending the device and a second means for suspending the device;

wherein the rigid arcuate element has rectilinear segments that are located parallel to a conditional line connecting the free ends of the device, rectilinear segments that are located perpendicular to the conditional line connecting the free ends of the device, and rectilinear segments that are located at an oblique angle to the conditional line connecting the free ends of the device;

wherein the first means for suspending the device are configured in the form of two segments, each outwardly extending from the central portion and having at a free end a hole for advancing a means for suspending; and wherein the second means for suspending the device are located at free ends of outermost segments of the device.

2. The training device according to claim 1, wherein the second means for suspending the device are made in the form of holes at the free ends of the outermost segments.

3. The training device according to claim 1, wherein the second means for suspending the device are made in the form of transverse slots at the free ends of the outermost segments.

* * * * *